US012350576B2

(12) United States Patent
Gauthier

(10) Patent No.: US 12,350,576 B2
(45) Date of Patent: Jul. 8, 2025

(54) ICE SKATING ASSIST SYSTEM

(71) Applicant: Rick Gauthier, Kenora (CA)

(72) Inventor: Rick Gauthier, Kenora (CA)

( * ) Notice: Subject to any disclaimer, the term of this patent is extended or adjusted under 35 U.S.C. 154(b) by 252 days.

(21) Appl. No.: 17/992,600

(22) Filed: Nov. 22, 2022

(65) Prior Publication Data

US 2024/0165488 A1 May 23, 2024

(51) Int. Cl.
*A63C 3/04* (2006.01)
*A63B 69/00* (2006.01)

(52) U.S. Cl.
CPC ..... *A63C 3/04* (2013.01); *A63B 69/0022* (2013.01)

(58) Field of Classification Search
CPC ..... A63C 3/04; A63C 3/00; A63B 69/0022; A61H 3/04; A61H 3/00
See application file for complete search history.

(56) References Cited

U.S. PATENT DOCUMENTS 923,556 A * 6/1909 Miller ..... A63B 69/0022 482/68
4,005,859 A * 2/1977 Tait ..... A63C 3/00 280/21.1
4,021,033 A * 5/1977 Auclair ..... A63C 3/04 482/66
4,915,373 A 4/1990 Walker
5,033,734 A 7/1991 Jalbert
D375,770 S 11/1996 Sicard
9,314,114 B2 4/2016 Davis
2017/0095717 A1* 4/2017 Simonov ..... A63B 69/0053
2019/0022494 A1 1/2019 Patterson

FOREIGN PATENT DOCUMENTS

WO WO2017120657 7/2017
WO WO-2017120657 A1 * 7/2017 ..... A63B 69/0022

* cited by examiner

*Primary Examiner* — Sundhara M Ganesan
*Assistant Examiner* — Jacqueline N L Loberiza

(57) ABSTRACT

An ice skating assist system for facilitating skating on a sheet of ice includes a sheet of ice and a support to facilitate upright stabilization of a person on the sheet of ice. The support includes a plurality of legs equally spaced laterally from each other and from a vertical center axis about which the plurality of legs is positioned. The support further includes a plurality of feet and a closed loop attached to each of the legs. A brace is coupled to each of the legs to reinforce a position of the legs with respect to each other. A strap is removably attached to the support and for inhibiting the person from falling on the sheet of ice.

7 Claims, 6 Drawing Sheets

(Front View)

(Bottom View)

(Side View)

(Perspective Top)

(In-Use)

(Side View)

ICE SKATING ASSIST SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to skating assist systems and more particularly pertains to a new skating assist system for facilitating skating on a sheet of ice.

(2) Description of Related Art Including Information Disclosed Under 37 CFR 1.97 and 1.98

The prior art relates to skating assist systems and includes a variety of systems having a sheet of ice for the user to ice skate on. The prior art further includes a variety of systems having a support to stabilize the user in an upright position. Known prior art does not include a support having a closed loop attached to a plurality of legs and a brace to reinforce each of the legs and have a removable strap for inhibiting the user from falling on the sheet of ice.

BRIEF SUMMARY OF THE INVENTION

An embodiment of the disclosure meets the needs presented above by generally comprising a sheet of ice and a support configured to facilitate upright stabilization of a person on the sheet of ice. The support includes a plurality of legs equally spaced laterally from each other and from a vertical center axis about which the plurality of legs is positioned. The support further includes a plurality of feet and a closed loop attached to each of the legs. A brace is coupled to each of the legs to reinforce a position of the legs with respect to each other. A strap is removably attached to the support and is configured for inhibiting the person from falling on the sheet of ice.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
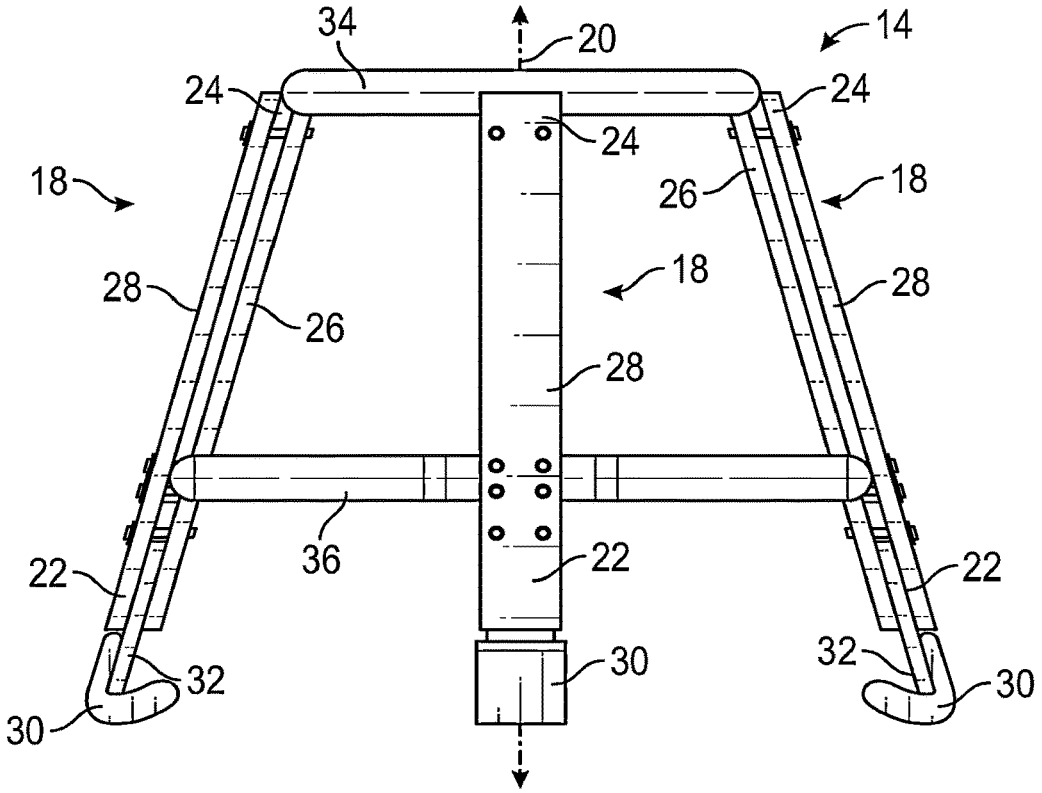
FIG. 1 is a front view of an ice skating assist system according to an embodiment of the disclosure.
Figure 2:
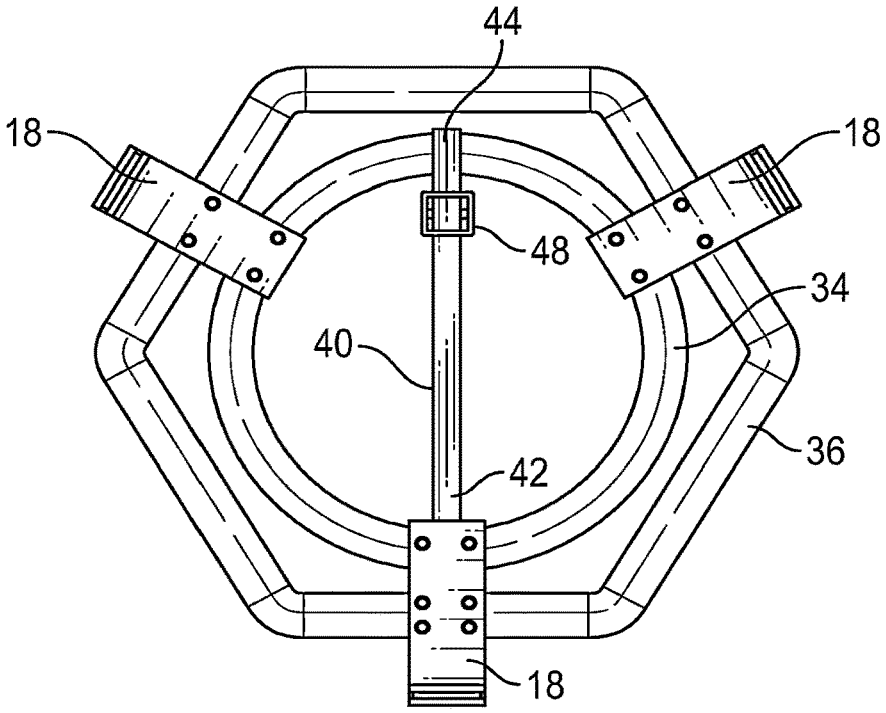
FIG. 2 is a bottom view of an embodiment of the disclosure.
Figure 3:
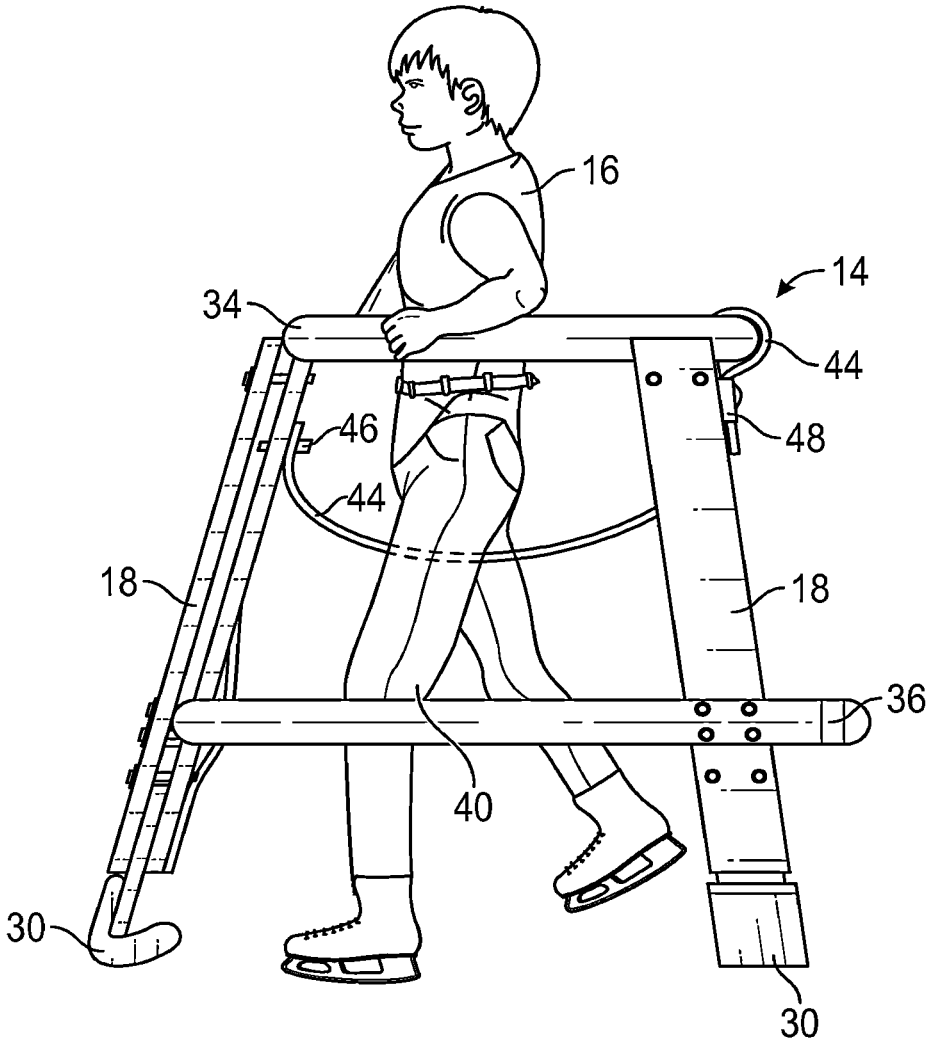
FIG. 3 is a side in-use view of an embodiment of the disclosure.
Figure 4:
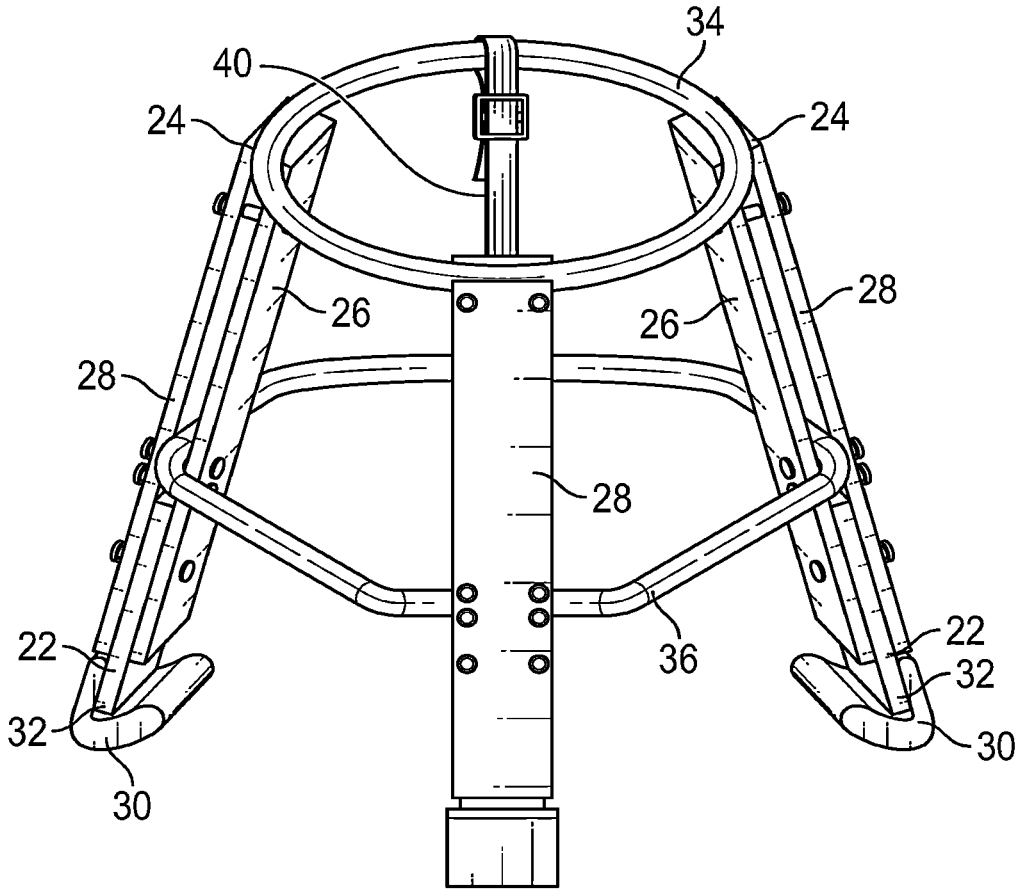
FIG. 4 is a perspective top view of an embodiment of the disclosure.
Figure 5:
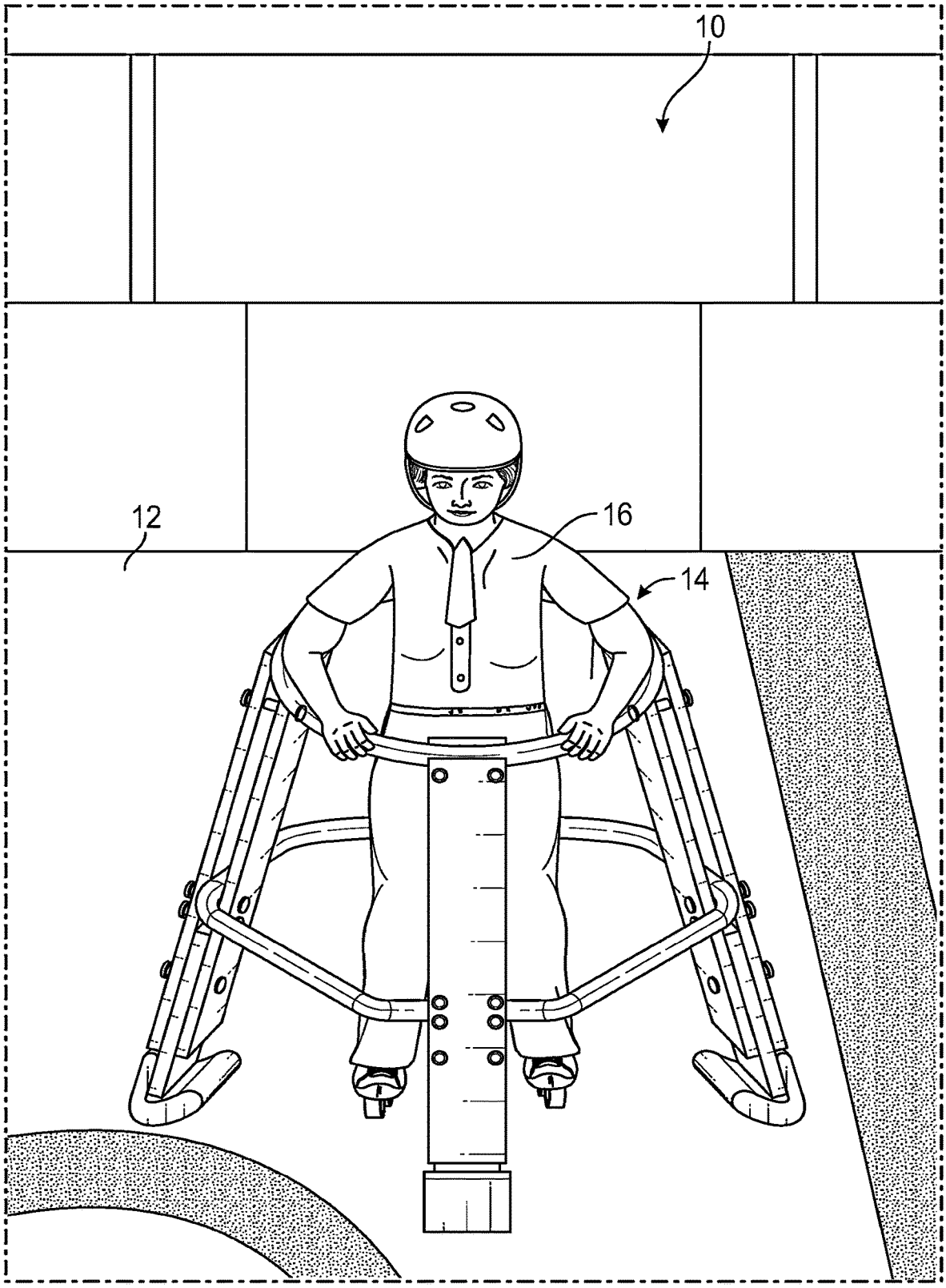
FIG. 5 is a perspective in-use view of an embodiment of the disclosure.
Figure 6:
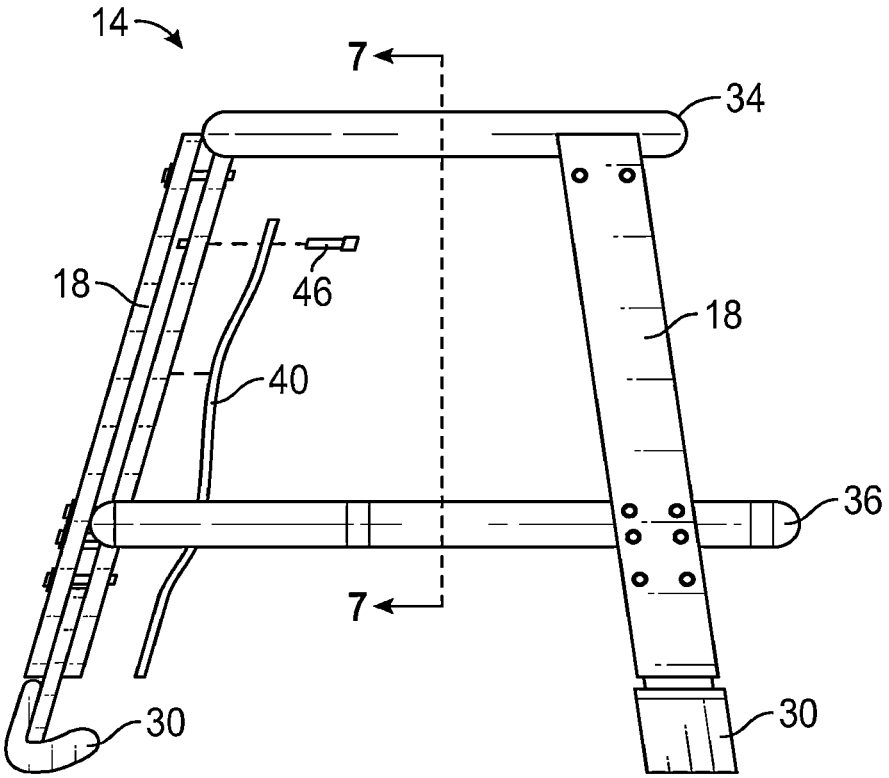
FIG. 6 is a side view of an embodiment of the disclosure.
Figure 7:
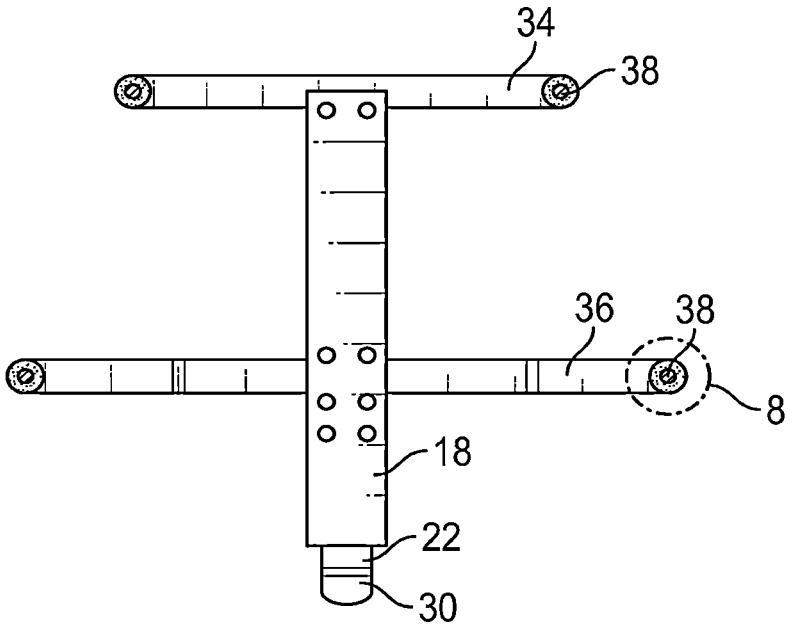
FIG. 7 is a cross-sectional view of an embodiment of the disclosure taken along Line 7-7 of FIG. 6.
Figure 8:
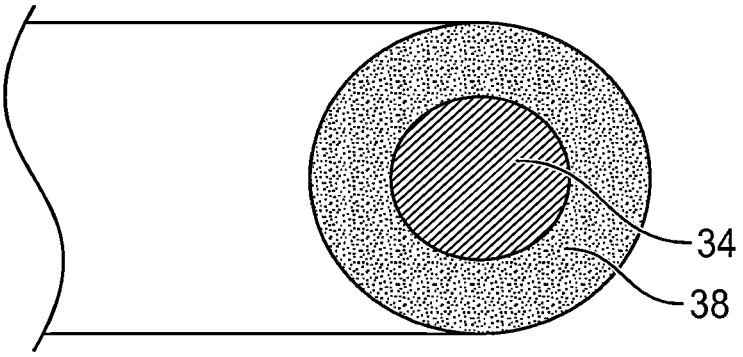
FIG. 8 is a detail view of an embodiment of the disclosure taken from Magnified Circle 8 of FIG. 7.

With reference now to the drawings, and in particular to FIGS. 1 through 8 thereof, a new skating assist system embodying the principles and concepts of an embodiment of the disclosure and generally designated by the reference numeral 10 will be described.

As best illustrated in FIGS. 1 through 8, the ice skating assist system 10 generally comprises a sheet of ice 12 and a support 14 configured to facilitate upright stabilization of a person 16 on the sheet of ice 12. The support 14 may include a plurality of legs 18 being equally spaced laterally from each other and from a vertical center axis about which the plurality of legs 18 are positioned, wherein the person 16 is positioned at the vertical center axis 20 when using the support 14. Each leg 18 may comprise a rigid material such as wood, metal, plastic, or any conventionally rigid material. Each leg 18 will typically have a height between 1.5 feet to 2.0 feet. The plurality of legs 18 is typically three legs being angled inwardly toward the vertical center axis 20 from a bottom end 22 to a top end 24 of the legs 18. The bottom end 22 of each leg 18 spaced from each other will typically have a spacing length between 2.0 feet to 2.5 feet. Each of the legs 18 includes an inner wall 26 and an outer wall 28 wherein the inner wall 26 is positioned nearer to the vertical center axis 20 than the outer wall 28. The plurality of legs 18 will typically have a plurality of feet 30 and each bottom end 22 of the legs 18 will have one of the feet 30 attached thereto. The feet 30 are configured for gliding the support 14 on the sheet of ice 12. Each of the feet 30 may comprise a panel being bent about a tip 32 of the bottom end 22 of each leg 18 and protruding upward towards the vertical center axis 20 of the support 14. The panel has a pair of end edges and each end edge may be convexly arcuate.

A closed loop 34 is attached to each of the legs 18 and is positioned adjacent to the top ends 24 of each of the legs 18. The closed loop 34 is at an apex of the support 14 and provides a graspable area for the person 16. The closed loop 34 will typically have a circular shape and be positioned between the inner 26 and outer 28 walls of each of the legs 18. A brace 36 is coupled to each of the legs 18 to reinforce a position of the legs 18 with respect to each other and may be spaced between the closed loop 34 and the bottom ends 22 of the legs 18. The brace 36 is a continuous loop and may have a hexagon shape or a triangle shape. The brace 36 is positioned between the inner 26 and outer 28 walls of each of the legs 18. The closed loop 34 and the brace 36 may each have a cover 38 comprising a resiliently compressible material such as foam.

A strap 40 is removably attached to the support 14 and is configured for inhibiting the person 16 from falling on the sheet of ice 12. The strap 40 has a first end 42 and a second end 44. The first end 42 has a coupler 46 for removably securing to the inner wall 26 of one of the legs 18 and the coupler 46 may comprise a bolt and nut assembly. The second end 44 may have a buckle 48 for removably fastening the second end 44 around the closed loop 34.

In use, the feet 30 of the legs 18 of the support 14 will be positioned on the sheet of ice 12 and the person 16 will be positioned within the vertical center axis 20 of the support 14. The person 16 begins to skate on the sheet of ice 12 while being stabilized in an upright position by grabbing onto the closed loop 34 of the support 14. The strap 40 may be attached to the support 14 to catch the person 16 from falling onto the sheet of ice 12 when the person 16 loses their balance.

With respect to the description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A skating assist system configured for facilitating ice skating, said skating assist system comprising:

a sheet of ice;

a support configured to facilitate upright stabilization of a person on the sheet of ice, said support including:

a plurality of legs being equally spaced laterally from each other and from a vertical center axis about which the plurality of legs are positioned;

a plurality of feet;

a closed loop being attached to each of said legs; and a brace being coupled to each of said legs to reinforce a position of said legs with respect to each other; and a strap being removably attached to said support and being configured for inhibiting the person from falling on said sheet of ice, wherein said strap has a first end and a second end, said first end having a coupler for removably securing to said inner wall of one of said legs, said coupler comprising a bolt and nut assembly, said second end having a buckle for removably fastening said second end around an exterior of said closed loop.

2. The skating assist system of claim 1, wherein the person is positioned at the vertical axis when using the support.

3. The skating assist system of claim 2, wherein said plurality of legs is three legs, said legs being angled inwardly toward the vertical center axis from a bottom end to a top end of said legs, each of said legs including an inner wall and an outer wall wherein said inner wall is positioned nearer to the vertical axis than said outer wall.

4. The skating assist system of claim 3, wherein each of the bottom ends of the legs has one of said feet attached thereto, said feet being configured for gliding on the sheet of ice, each of said feet comprising a panel being bent about a tip of said bottom end and protruding upward towards said vertical center axis, said panel having a pair of end edges and each end edge being convexly arcuate.

5. The skating assist system of claim 4, wherein said closed loop is positioned adjacent to the top ends of each of said legs, said closed loop being at an apex of the support and providing a graspable area for the person, said closed loop having a circular shape, said closed loop being positioned between said inner and outer walls of each of said legs.

6. The skating assist system of claim 5, wherein said brace is spaced between said closed loop and said bottom ends of said legs, said brace being a continuous loop having a hexagon shape, said brace being positioned between said inner and outer walls of each of said legs.

7. A skating assist system configured for facilitating ice skating, said skating assist system comprising:

a sheet of ice;

a support configured to facilitate upright stabilization of a person on the sheet of ice, said support including:

a plurality of legs being equally spaced laterally from each other and from a vertical center axis about which the plurality of legs are positioned, wherein the person is positioned at the vertical center axis when using the support, said plurality of legs being three legs, said legs being angled inwardly toward the vertical center axis from a bottom end to a top end of said legs, each of said legs including an inner wall and an outer wall wherein said inner wall is positioned nearer to the vertical center axis than said outer wall;

a plurality of feet, each of the bottom ends of the legs having one of said feet attached thereto, said feet being configured for gliding on the sheet of ice, each of said feet comprising a panel being bent about a tip of said bottom end and protruding upward towards said vertical center axis, said panel having a pair of end edges and each end edge being convexly arcuate;

a closed loop being attached to each of said legs, said closed loop being positioned adjacent to the top ends of each of said legs, said closed loop being at an apex of the support and providing a graspable arca for the person, said closed loop having a circular shape, said closed loop being positioned between said inner and outer walls of each of said legs; and a brace being coupled to each of said legs to reinforce a position of said legs with respect to each other, said brace being spaced between said closed loop and said bottom ends of said legs, said brace being a continuous loop having a hexagon shape, said brace being positioned between said inner and outer walls of each of said legs; and a strap being removably attached to said support and being configured for inhibiting the person from falling on said sheet of ice, said strap having a first end and a second end, said first end having a coupler for removably securing to said inner wall of one of said legs, said coupler comprising a bolt and nut assembly, said second end having a buckle for removably fastening said second end around an exterior of said closed loop.

* * * * *